United States Patent [19]

Rentrop et al.

[11] Patent Number: 4,657,432

[45] Date of Patent: Apr. 14, 1987

[54] INSTALLATION FOR GROUND STABILIZATION IN HYDRAULIC ENGINEERING

[75] Inventors: Peter W. Rentrop, Altena; Günter H. Trapp, Lüdenscheid; Friedrich W. Dunker, Altena, all of Fed. Rep. of Germany

[73] Assignee: Joh. Moritz Rump Kommanditgesellschaft, Altena, Fed. Rep. of Germany

[21] Appl. No.: 786,954

[22] PCT Filed: Sep. 11, 1984

[86] PCT No.: PCT/DE84/00186

§ 371 Date: Sep. 30, 1985

§ 102(e) Date: Sep. 30, 1985

[87] PCT Pub. No.: WO85/03539

PCT Pub. Date: Aug. 15, 1985

[30] Foreign Application Priority Data

Jan. 31, 1984 [DE] Fed. Rep. of Germany ..... 3403165

[51] Int. Cl.[4] ..... E02B 3/04

[52] U.S. Cl. ..... 405/24; 52/750; 405/25

[58] Field of Search ..... 405/24, 21, 23, 25; 52/750

[56] References Cited

U.S. PATENT DOCUMENTS

| | | | |
|---|---|---|---|
| 3,323,310 | 6/1967 | Arpih | 405/24 |
| 3,727,411 | 4/1973 | Rhodes | 405/24 |
| 4,077,222 | 3/1978 | Larsen | 405/21 |
| 4,337,007 | 6/1982 | Smith | 405/24 |
| 4,374,629 | 2/1983 | Garrett | 405/24 |
| 4,478,533 | 10/1984 | Garrett | 405/24 |

FOREIGN PATENT DOCUMENTS

| | | | |
|---|---|---|---|
| 45437 | 4/1971 | Australia . | |
| 135462 | 5/1977 | Denmark . | |
| 0018082 | 10/1980 | European Pat. Off. . | |
| 8404118 | 10/1984 | European Pat. Off. | 405/24 |
| 2807446 | 8/1979 | Fed. Rep. of Germany . | |
| 8231725 | 3/1983 | Fed. Rep. of Germany . | |
| 7041878 | 9/1971 | France . | |
| 7105253 | 11/1971 | France . | |
| 0142805 | 11/1980 | Japan | 405/24 |
| 0003905 | 1/1982 | Japan | 405/25 |
| 1176772 | 1/1970 | United Kingdom | 405/24 |

*Primary Examiner*—Cornelius J. Husar
*Assistant Examiner*—Kristina I. Hall
*Attorney, Agent, or Firm*—Karl F. Ross; Herbert Dubno

[57] ABSTRACT

A device for ground stabilizing in hydraulic engineering comprises a structural steel mat to the bars of which are clipped grass support elements which have an upwardly open trough-shape in which grass-like ribbon elements are held by a further bar fitted into the trough and gripped thereby.

20 Claims, 12 Drawing Figures

INSTALLATION FOR GROUND STABILIZATION IN HYDRAULIC ENGINEERING

CROSS REFERENCE TO RELATED APPLICATIONS

The present application is a national phase application corresponding to PCT/DE84/00186, filed Sept. 11, 1984 and based upon a German application P3403165.0 of Jan. 31, 1984 under the International Convention.

FIELD OF THE INVENTION

The invention relates to an installation for ground stabilization in hydraulic engineering consisting of mats formed by bars anchorable into the ground at least by their own weight, with artificial grass fixed thereto, wherein the bars are connected to form a mat having meshes.

BACKGROUND OF THE INVENTION

An installation of this kind for the protection against erosion of foundations in river- or marine constructions is known from the German Utility Model 82 31 725.9.

In this known installation, artificial and mainly floatable grass fibers are tied to straight bars anchorable into the ground at least by their own weight, these bars being lowered to the bottom of the water body, thereby not only impeding erosion, but also facilitating the deposition of ground particles carried by the water current.

It is also known from German Utility Model 82 31 725.9 to connect several of the afore-mentioned grass supports by means of traction elements such as chains, with spaces between them, to form a mat and to launch this mat into the water from a boat.

But particularly when the water current is strong there is a risk that during the lowering of the mat consisting of several grass supports, these supports are carried away differently and come to lie upon each other and, as a result, their intended positioning towards each other and the thereby intended effects are not reached.

Also, the production of such installations known to the art is relatively complicated and expensive.

OBJECT OF THE INVENTION

The object of this invention is to improve such an installation in order to achieve through simplification and cost-reduction of the construction an installation with an essentially higher degree of stable positioning of the grass support elements, thereby also creating the possibility of preselecting the most advantageous positioning of the grass supports in each case.

SUMMARY OF THE INVENTION

The solution to this problem is a mat made of structural steel with struts carrying prefabricated and interchangeable bar-shaped grass supports.

Such a mat carrying grass support elements does not permit any displacement of the grass supports with respect to each other, due to the undetachable and rigid connection of its struts. In spite of that, the mat is capable to adjust to a certain degree to the more or less uneven bottom of the water body, when flatly lowered to the ground. Besides, afore-described installation has remarkably lower production costs, since the commonly used structural steel mats can be used in this case.

It is also possible to affix the grass supports to the construction steel mat in a variety of patterns different from each other and in dependence from the respective predominant water current to achieve the best effects.

It is advantageous to the principle of the invention when the structural steel mat has bars perpendicular to each other and in addition the meshes of the steel structure are respectively limited by bar sections of similar length and also when the length of a bar-shaped grass support corresponds approximately to the clearance between bar sections opposite to each other of a mesh of the steel structure.

An embodiment particularly advantageous from the point of view of the production of the grass supports themselves, as well as from the point of view of their connection to the structural steel web and which also ensures a stable positioning of the grass supports towards each other is characterized by that the grass support elements are made of a first trough-like profile bar and of a second bar having at least the same length with the first, surrounded by grass fibers and fitted into the first profile bar and by that on the trough-shaped profile bar elements for the connection to the structural steel web are provided.

In addition, it is advantageous from the point of view of the production that the connection device be tip-stretched to the trough-shaped first profile bar.

In order to quickly and securely connect the grass support elements to the bars of the mat made of structural steel web, the connection elements have to be made in a hook-like manner and preferably to be clamped over and to surround the bars of the structural steel web.

A preferred and particularly cost-effective embodiment is characterized by a first extruded trough-shaped profile element, especially made of synthetic material with a profile part having a hook-like shape tip-stretched thereto and extending over its entire length and capable to be clamped over a bar of the structural-steel web mat.

It is also possible to make the grass support elements longer than the mesh of the structural-steel web mat, in order to produce the pattern of grass support elements most suitable to the predominant conditions. In this case, it is advantageous, particularly in order to obtain short and material-saving connections, to provide in the hook-like shaped profile at least one longitudinally opening recess, whose clearance cross section corresponds at least to the cross section of one bar of the structural-steel web mat crossing the bar of the steel structure to which the grass support element is connected.

Besides, for the simplification of the connection between the grass supports and the structural-steel mat, the devices for the connection of the grass supports should be located along the side opposed to the grass fibers protruding from the trough of the first trough-shaped profile bar.

In this way, the erection of the floatable grass fibers in the correct position after the installation has been lowered into the water is facilitated. For this purpose, the second bar surrounded by the grass fibers can have an annular circular profile and that the trough of the first profile bar is adjusted to the profile of the second bar so that the first profile bar surrounds the second profile bar, including the grass fibers, in a form-locked manner by more than 180°.

BRIEF DESCRIPTION OF THE DRAWING

Embodiments of the invention are represented in the drawing and are described in detail as follows; the drawing shows.

SPECIFIC DESCRIPTION

Figure 1:
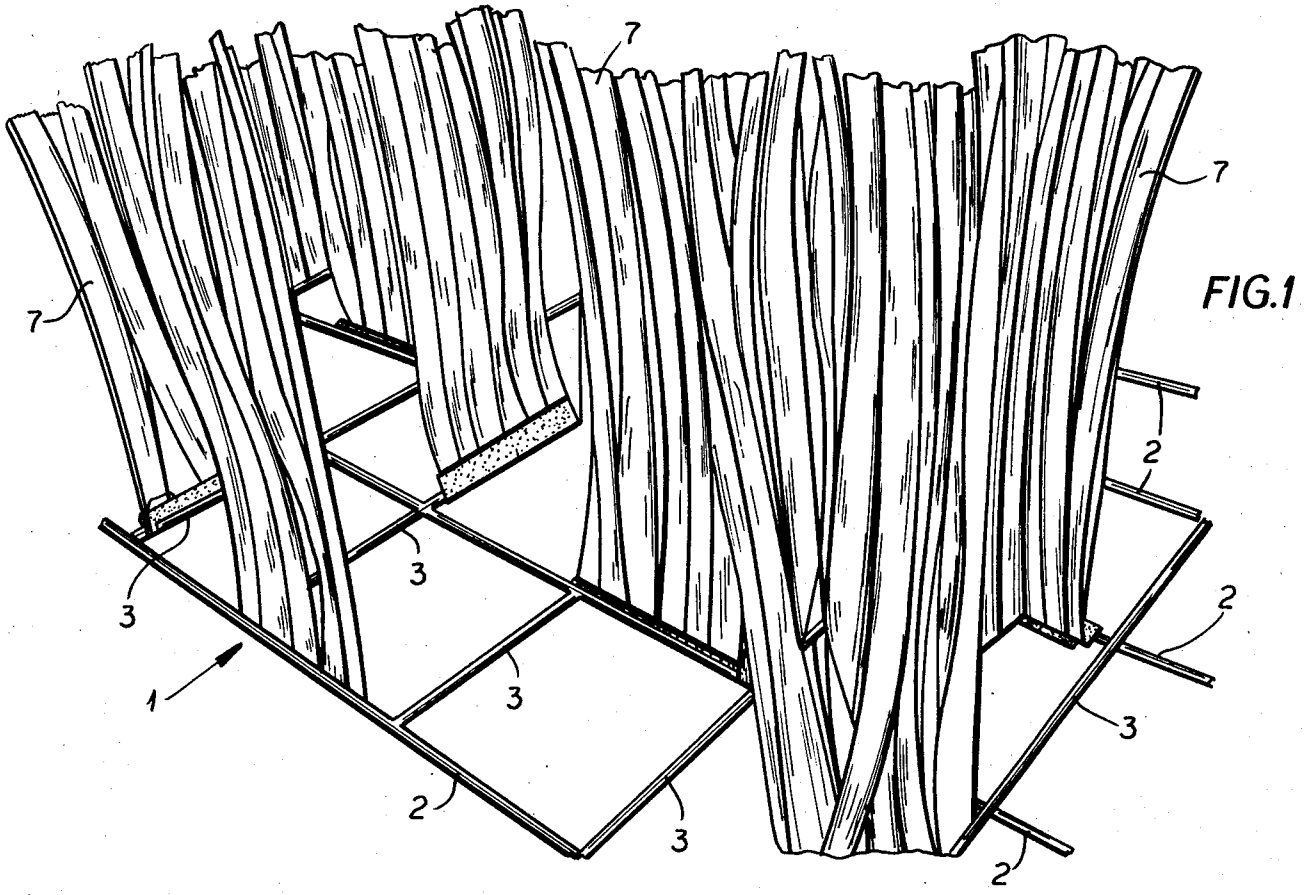
FIG. 1 a part of an installation for ground stabilization in hydraulic engineering, in perspective.
Figure 2:
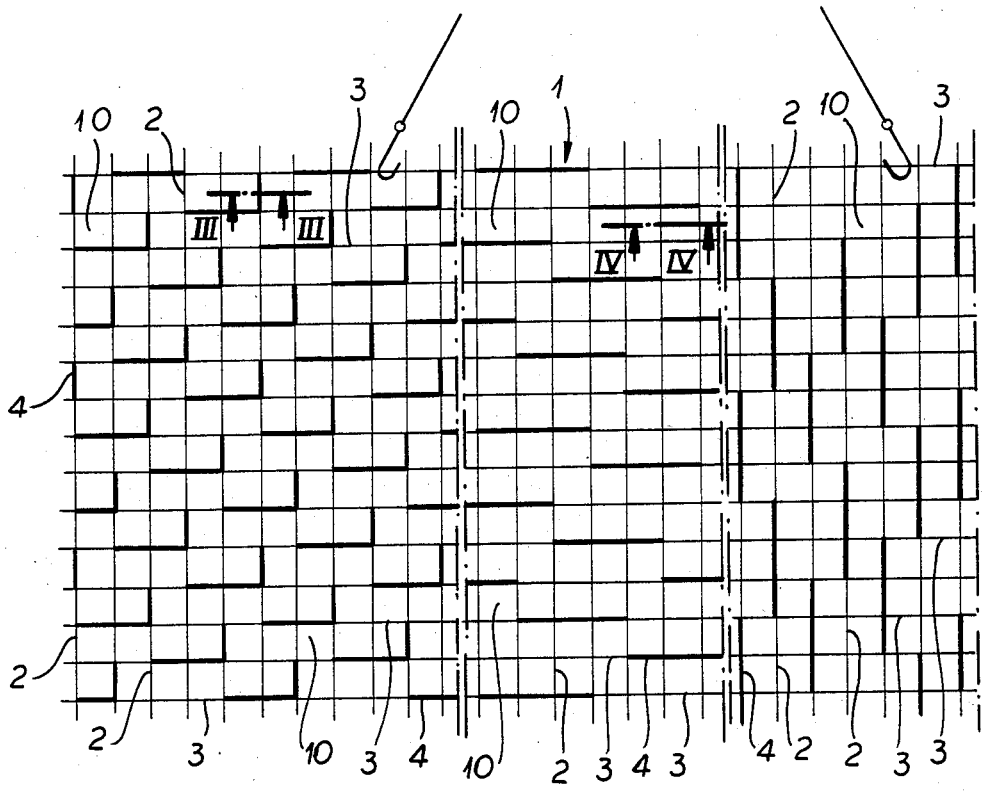
FIG. 2 the same in a top view.
Figure 3:
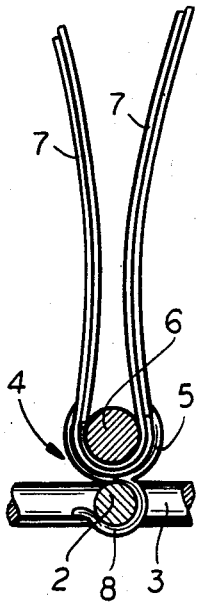
FIG. 3 details of the same in enlarged scale according to the line III—III of FIG. 2.

All embodiments have a common feature a rectangular mat made of a structural-steel web 1 consisting of longitudinal bars 2 and crossbars 3 perpendicular to each other with grass support elements 4 fixed to the afore-mentioned bars.

The bars 2 and 3 are connected undetachably and rigidly at their intersections.

Further, the longitudinal bars 2 are parallel to the longitudinal side and the crossbars 3 are parallel to the transverse sides of the structural-steel mat 1.

The bars 2 and 3 have respectively over their entire length the same circular cross section. Their diameter is approximately 6 mm.

In addition, grass support elements 4 are provided which consist respectively of a first extruded bar 5 and a second bar 6 which is built as segment of a round bar. Synthetic grass fibers 7 made of a floatable synthetic material and preferably shaped as bendable ribbons are arranged in great numbers over the entire length of the grass supports 4. The first bar 5 is trough-shaped and has along its side turned away from the trough an outwardly tip-stretched hook-like profiled part 8, extending over the entire length of the bar.

The grass fibers 7, which can have an effective length of approximately 90 cm are wound around the bar 6 and inserted with the bar 6 into the trough of bar 5. The trough of the bar 5 is so dimensioned that it surrounds the bar 6 including the grass fibers 7 with a clamping effect over more than 180°. The hook-like profile section 8, on the contrary, is clamped over one of the bars 2 or 3 of the structural-steel mat 1 in a manner to ensure that all grass fibers of the installation lowered in to the water can erect themselves in the same direction as before with respect to each other.

Generally, the length of the grass support elements 4 corresponds to the distance between two neighboring bars 2, or 3 running in the same direction, so that the grass supports 4 rest with their frontal sides against the afore-mentioned bars and therefore are unadjustably supported in their longitudinal direction.

Figure 4:
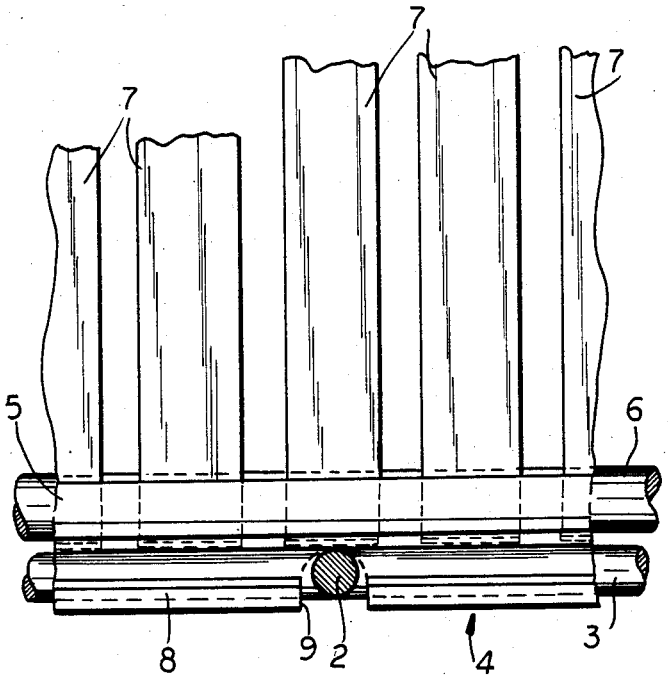
FIG. 4 the same in the direction of the line IV—IV at FIG. 2.

It is also possible, as shown in FIG. 4, to provide a recess 9 in the grass support element 4, namely in the profile segment 8, this recess surrounding the bar which crosses the bar to which the grass support element 4 is connected. This embodiment allows the grass support element 4 to have a length that surpasses the width of one mesh of the structural-steel web mat 1.

In the structural-steel web mat 1 shown in FIG. 4, the longitudinal- and crossbars 2, respectively 3 are arranged at the same level with respect to each other. But it is also possible to arrange the longitudinal- and crossbars 2 and 3 longitudinally adjacent to each other in two planes and to connect them rigidly to each other.

Figure 5:
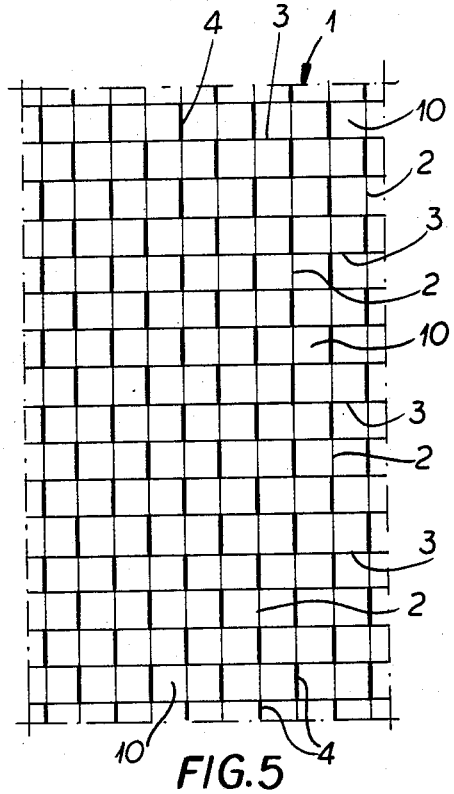
FIGS. 5 to 12 top views of sections of installations with the grass fibers arranged in different patterns with respect to each other.
Figure 6:
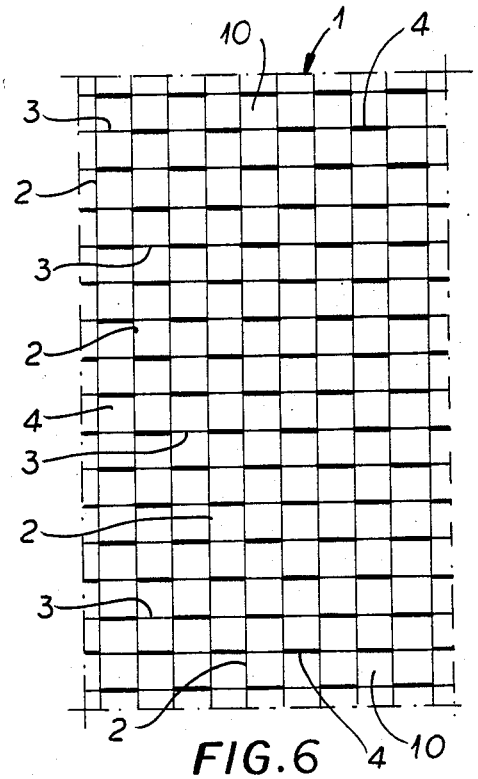

In accordance to FIG. 5, to each longitudinal bar 2 of the steel mat 1 grass supports 4 are fastened, namely in rows and spaced apart by an interval equal to the width of a mesh, whereby the grass support elements 4 are arranged in the same direction with respect to the longitudinal bars 2, while in accordance to FIG. 6, all crossbars 3 are provided with grass supports 4, similarly as in FIG. 5.

Figure 7:
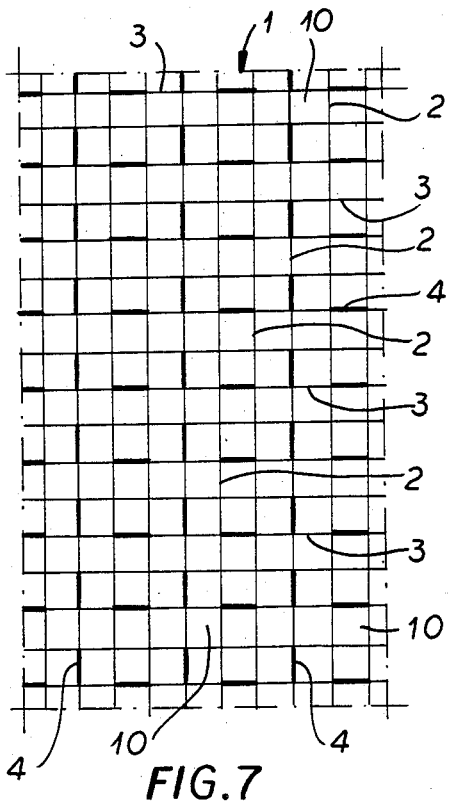

In FIG. 7, grass support elements 4 are fastened to the longitudinal bars 2, as well as to the crossbars 3, whereby a space equal to the width of one mesh is provided between the individual grass supports.

Figure 8:
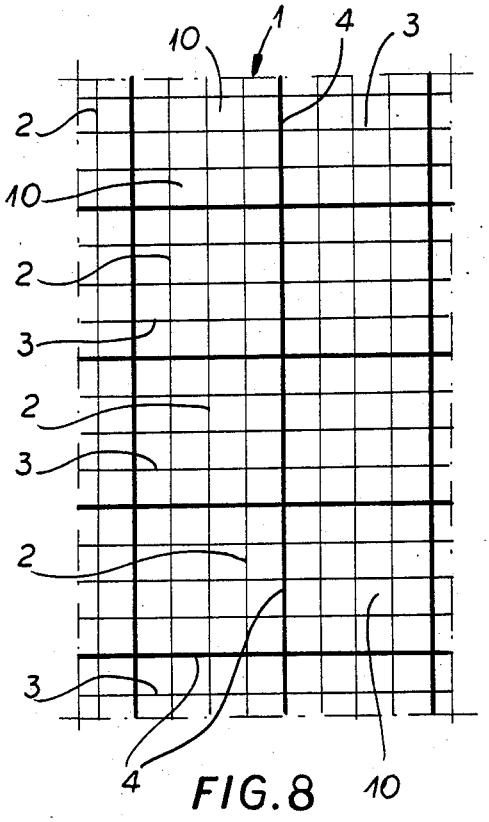

In the installation shown in FIG. 8, the grass support elements 4 are arranged so that a plurality of grass supports 4 arranged longitudinally and directly one behind the other on the longitudinal- as well as on the crossbars form squares.

Figure 9:
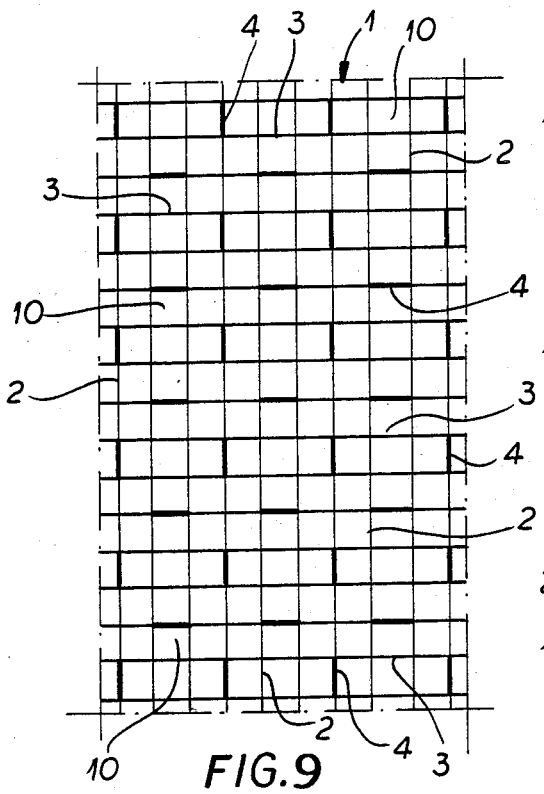

In accordance with FIG. 9, groups of four grass support elements 4 are connected to each other to form a square, whereby the corners of the square are left free of grass fibers.

Figure 10:
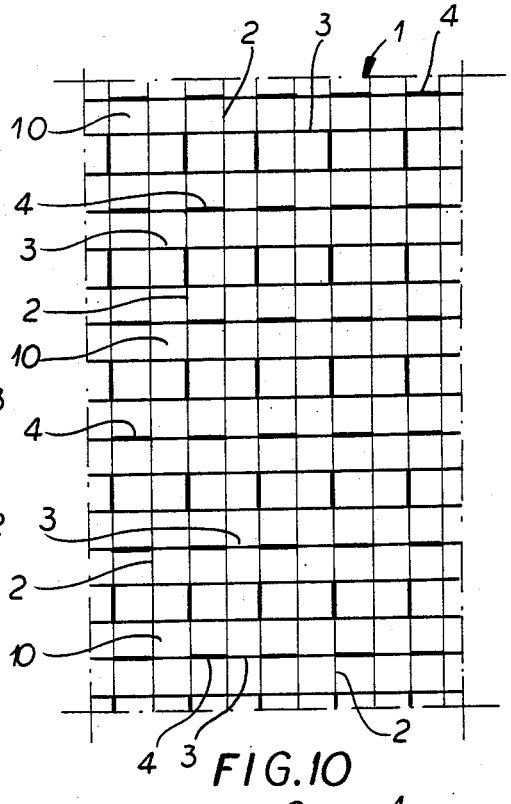
Figure 11:
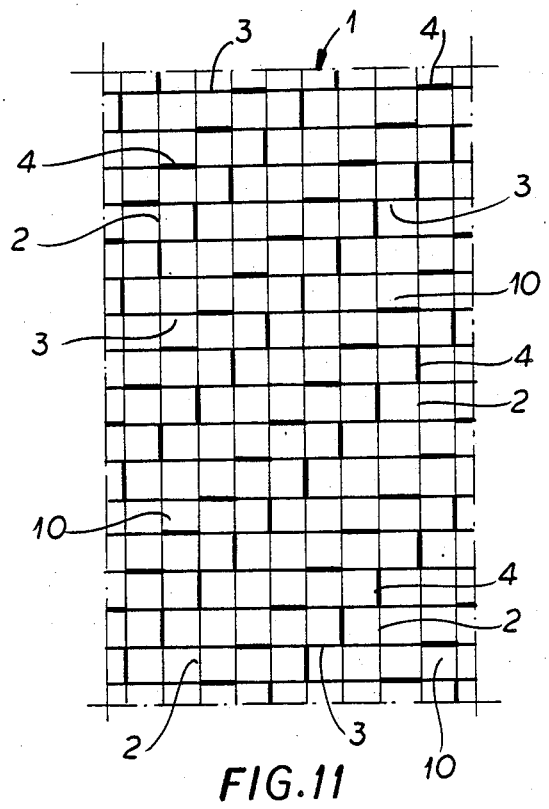

In FIG. 10 on each second longitudinal bar 2 and on each third crossbar 3 a grass support 4 is fastened, whereby between the grass supports 4 fastened to the longitudinal bars 2 a space is left which is twice as big as the width of the mesh, while the grass supports 4 fastened to the crossbars 3 are arranged at a distance from each other equaling the width of the mesh. In addition, only the crossbars 3 located between the grass supports 4 of the longitudinal bars 2 are carrying grass supports 4. In FIG. 11, the installation shown presents a herringbone pattern arrangement of the grass supports 4, whereby the grass supports 4 fastened to the crossbars 3 are offset in steps at intervals equal to the width of a mesh, while the grass supports 4 fastened to the longitudinal bars are also offset in transversal direction to the steel mat 1 by the width of one mesh upwardly, respectively downwardly.

Figure 12:
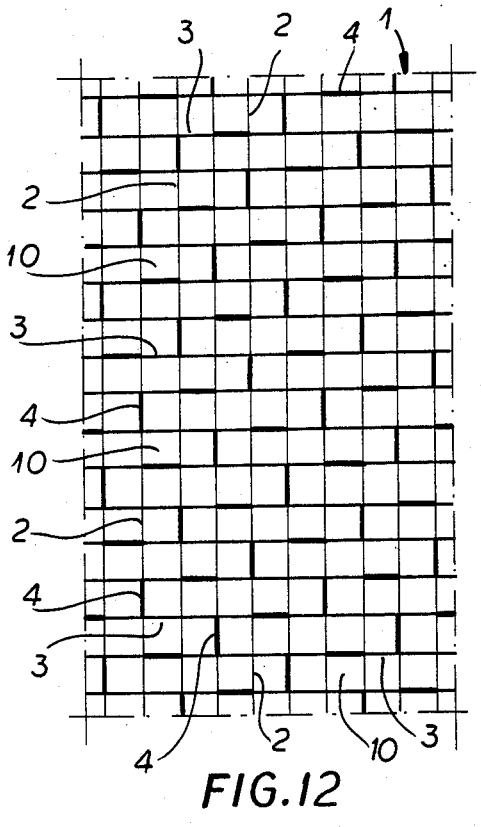

In the installation shown in FIG. 12, four respective grass support elements 4 compose together a square, whereby the length of the sides of this square are double the length of a grass support element and whereby the grass supports 4 are arranged in the circumferential direction of the square with spaces between them equal to the width of a mesh.

It is also possible to connect several such mats into one larger mat.

Besides, it is advantageous when the structural-steel web mats 1 are separated longitudinally or transversally in several relatively narrow strips and these strips are jointedly connected to each other, so that the structural-steel web mat 1 can be rolled up for transportation.

Rings engaging into each other can be mounted, respectively tip-stretched to the bars of the structural-steel web mat to serve as jointed connections. Such a jointed connection of the structural-steel web mat stripes can also be achieved through bendable elements, for instance cables. This embodiment facilitates an even better adjustment of the steel mat 1 when deposited on an uneven surface under water than the previous one.

The grass support elements 4 tied to the bars 2 respectively 3 can hinge around the bars they are connected to, up to a certain degree, by overcoming the clamping force, so that during transportation they have the same direction as the plane of the structural-steel mat 1 and therefore the entire installation takes up less space during transportation than before.

Besides, the risks of breaking the grass support elements 4 are diminished.

We claim:

1. A device for ground stabilization in hydraulic engineering, comprising:

a structural steel web mat provided with mutually spaced parallel longitudinal mat bars and mutually spaced parallel transverse mat bars fixed together and adapted to anchor the device to the ground at least by the weight thereof;

grass-like fibers adapted to be held by said mat against said ground;

grass support elements attached to at least some of said mat bars, each of said grass support elements comprising;

a first profile bar having a trough-shaped profile, a connection means formed on said first profile bar for connection thereof to a mat bar of said structural steel web mat, and a second profile bar having at least the same length as said first profile bar and having said grass-like fibers extending therearound fitted into said trough and retaining said grass-like fibers on said grass support element.

2. The device defined in claim 1 wherein said longitudinal and transverse bars cross each other at right angles.

3. The device defined in claim 1 wherein said longitudinal and transverse bars define meshes with each of said meshes being formed by bar segments of approximately the same length.

4. The device defined in claim 1 wherein the length of each of said grass support elements is approximately equal to the spacing between parallel mat bars.

5. The device defined in claim 1 wherein each of said connection means is a hook-like member adapted to be separated by but hooked around a respective one of said mat bars.

6. The device defined in claim 5 wherein said member and the respective first profile bar are formed unitarily as an extrusion from synthetic material and said member extends substantially the full length of said first profile bar.

7. The device defined in claim 6 wherein each grass support element extends along one of said mat bars and crosses another mat bar, said member being cut away to form a recess whose cross section corresponds at least to the cross section of a mat bar crossed by the respective grass support element..

8. The device defined in claim 1 wherein said connection means is formed on said first profile bar of each grass support element on a side thereof opposite to a side from which said grass-like fibers protrude from the trough of the respective first profile bar.

9. The device defined in claim 1 wherein each of said second bars has a circular profile and the trough-shaped profile of the respective first profile bar engages around the respective second bar and the grass-like fibers thereon in a form-locked manner by more than 180°.

10. The device defined in claim 1 wherein said mat is rectangular.

11. The device defined in claim 1 wherein said grass support elements are mounted only on said longitudinal mat bars.

12. The device defined in claim 1 wherein said grass support elements are mounted only on said transverse mat bars.

13. The device defined in claim 1 wherein said grass support elements are provided on both said longitudinal and transverse mat bars.

14. The device defined in claim 1 wherein said grass support elements are spaced apart along respective mat bars by a distance equal to the width of at least one mesh of the mat.

15. The device defined in claim 14 wherein the grass support elements along each of said mat bars are spaced apart by a distance equal to several mesh widths.

16. The device defined in claim 1, wherein said grass support elements are positioned at the sides of polygons.

17. The device defined in claim 16 wherein said polygons are free from said grass support elements at corners of said polygons.

18. The device defined in claim 1 wherein said grass support elements are spaced apart along mutually parallel mat bars with a mutual spacing of at least one mesh width.

19. The device defined in claim 18 wherein said grass support elements are arranged on said mat in a herringbone pattern.

20. The device defined in claim 1 wherein each four grass support elements combine to form a square, the length of each grass support element corresponds to the width of one mesh, and the sides of the square are each twice the width of one mesh while between neighboring grass support elements a space equal to the width of one mesh of the mat is provided.

* * * * *